US010726780B2

(12) United States Patent
Shim et al.

(10) Patent No.: US 10,726,780 B2
(45) Date of Patent: Jul. 28, 2020

(54) AGING SYSTEM AND METHOD FOR OPERATING THE SAME

(71) Applicant: SAMSUNG DISPLAY CO., LTD., Yongin-si, Gyeonggi-do (KR)

(72) Inventors: Chan Wook Shim, Yongin-si (KR); Wan Bae Park, Yongin-si (KR); Eun Chul Shin, Yongin-si (KR); Il Ho Lee, Yongin-si (KR); Cheol Gon Choi, Yongin-si (KR); Tae Yong Kim, Yongin-si (KR); Hyung Chul Kim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 91 days.

(21) Appl. No.: 15/945,866

(22) Filed: Apr. 5, 2018

(65) Prior Publication Data

US 2019/0080647 A1 Mar. 14, 2019

(30) Foreign Application Priority Data

Sep. 11, 2017 (KR) ..... 10-2017-0115840

(51) Int. Cl.
*G09G 3/3225* (2016.01)

(52) U.S. Cl.
CPC ..... *G09G 3/3225* (2013.01); *G09G 2320/043* (2013.01); *G09G 2320/046* (2013.01); *G09G 2330/12* (2013.01)

(58) Field of Classification Search
None
See application file for complete search history.

(56) References Cited

U.S. PATENT DOCUMENTS 8,400,437 B2 3/2013 Kim et al.
2007/0001711 A1* 1/2007 Kwak ..... G09G 3/006 324/762.07

FOREIGN PATENT DOCUMENTS

KR 101296907 B1 8/2013

* cited by examiner

*Primary Examiner* — Amare Mengistu
*Assistant Examiner* — Sarvesh J Nadkarni
(74) *Attorney, Agent, or Firm* — Cantor Colburn LLP

(57) ABSTRACT

An aging system includes panel groups each including display panels, an auxiliary board including the panel groups disposed thereon, and an aging device for supplying aging signals to the display panels through line boards to perform aging on the display panels, where the aging device supplies switch signals respectively to the display panels through the line boards, where each of the display panels includes a switch unit for supplying the aging signal to a pixel unit according to the switch signal.

13 Claims, 6 Drawing Sheets

AGING SYSTEM AND METHOD FOR OPERATING THE SAME

This application claims priority to Korean Patent Application No. 10-2017-0115840, filed on Sep. 11, 2017, and all the benefits accruing therefrom under 35 U.S.C. § 119, the content of which in its entirety is herein incorporated by reference.

BACKGROUND

1. Field

Exemplary embodiments of the invention relate to an aging system and a method for operating the same.

2. Description of the Related Art

As the information society is developed, demands for display devices for displaying an image have been increased in a variety of forms. Accordingly, various flat panel display devices such as a liquid crystal display device ("LCD"), a plasma display panel ("PDP"), and an organic light emitting diode ("OLED") display device have recently been used. Among these flat panel display devices, the OLED display device has advantages such as a low voltage driving, a thin thickness, an excellent viewing angle, and a fast response speed.

In general, panels of a plurality of OLED display devices are formed on one mother board and then scribed, to be separated as individual panels.

After that, the separated panels are placed on an auxiliary board, and aging may be simultaneously performed on the plurality of panels placed on the auxiliary board.

By considering that degradation rapidly proceeds in the early stage when an OLED is driven and then is stabilized, the aging is performed to appropriately pre-compensate for the degradation by allowing the OLED to be degraded to a certain extent as the OLED is previously driven before a product is released and then adjusting a driving voltage.

Therefore, in order to perform the aging, the panels are desired to be driven by supplying driving power sources and/or driving signal to the respective panels.

That is, a predetermined current flows through the OLED by simultaneously supplying driving power sources and/or driving signals to the plurality of panels formed on the auxiliary board, particularly, by supplying an aging signal to data lines of pixels.

SUMMARY

Exemplary embodiments provide an aging system that enables aging to be efficiently performed on a plurality of display panels located on an auxiliary board and a method for operating the aging system.

According to an exemplary embodiment of the invention, there is provided an aging system including panel groups each including display panels, an auxiliary board including the panel groups disposed thereon, and an aging device which supplies aging signals to the display panels through line boards to perform aging on the display panels, where the aging device supplies switch signals respectively to the display panels through the line boards, where each of the display panels includes a switch unit which supplies an aging signal of the aging signals to a pixel unit according to a switch signal of the switch signals.

In an exemplary embodiment, the switch unit may include at least one switch switched according to the switch signal.

In an exemplary embodiment, the switch may be any one of an N-type metal-oxide-semiconductor ("N-MOS") transistor and a P-type metal-oxide-semiconductor ("P-MOS") transistor.

In an exemplary embodiment, the aging device may include an aging signal supply unit which supplies the aging signals respectively to the panel groups through group signal lines corresponding to the panel groups, a switch signal supply unit which supplies the switch signals respectively to the display panels through switch signal lines corresponding to the display panels, and a power supply unit which supplies an aging power source to the display panels through power lines corresponding to the display panels.

In an exemplary embodiment, the aging device may further include a controller which controls the aging signal supply unit, the switch signal supply unit, and the power supply unit.

In an exemplary embodiment, each of the group signal lines, the switch signal lines, and the power lines may be disposed on a corresponding one of the line boards.

In an exemplary embodiment, the switch signal supply unit may block a supply of all of the switch signals. The aging signal supply unit may supply the aging signals to the display panels, and detect a board error of the line boards.

In an exemplary embodiment, the switch signal supply unit may block the supply of switch signals to only a panel group coupled to only a line board in which the board error occurs.

In an exemplary embodiment, the aging signal supply unit may supply the aging signals to the display panels, and detect a panel error of the display panels.

In an exemplary embodiment, the switch signal supply unit may block the supply of a switch signal of the switch signals to a display panel of the display panels in which the panel error occurs.

According to an exemplary embodiment of the invention, there is provided a method for operating an aging system that includes panel groups each including display panels, an auxiliary board including the panel groups disposed thereon, and an aging device which supplies aging signals to the display panels through line boards, the method including detecting a board error, blocking a supply of switch signals to a panel group coupled to a line board in which the board error occurs, detecting a panel error, blocking the supply of switch signals to a display panel of the display panels in which the panel error occurs, and performing aging on the display panels, where each of the display panels includes a switch unit which supplies an aging signal of the aging signals to a pixel unit according to a switch signal of the switch signals.

In an exemplary embodiment, in the detecting the board error, the aging device may detect the board error by blocking the supply of all of the switch signals and then supplying the aging signals to the display panels for a first supply time.

In an exemplary embodiment, in the detecting the panel error, the aging device may detect the panel error by supplying the aging signals to the display panels for the first supply time.

In an exemplary embodiment, in the performing the aging on the display panels, the aging device may perform the aging by supplying the aging signals to the display panels for a second supply time. The first supply time may be shorter than the second supply time.

According to an exemplary embodiment of the invention, there is provided a method for operating an aging system that includes panel groups each including display panels, an auxiliary board including the panel groups disposed thereon, and an aging device which supplies aging signals to the display panels through line boards, the method include detecting an error, blocking a supply of a switch signal to a display panel of the display panels in which the error occurs, determining whether the error is a board error, blocking the supply of switch signals to a panel group coupled to a line board in which the board error occurs, and performing aging on the display panels, where each of the display panels includes a switch unit which supplies the aging signal to a pixel unit according to the switch signal.

In an exemplary embodiment, in the detecting the error, the aging device may detect the error by supplying the aging signals to the display panel for a first supply time.

In an exemplary embodiment, in the determining whether the error is the board error, the aging device may supply the aging signals to the display panels for the first supply time, and determine that the error is the board error when the error continuously occurs.

In an exemplary embodiment, in the performing the aging on the display panels, the aging device may perform the aging by supplying the aging signals to the display panels for a second supply time. The first supply time may be shorter than the second supply time.

BRIEF DESCRIPTION OF THE DRAWINGS

Exemplary embodiments will now be described more fully hereinafter with reference to the accompanying drawings, in which.

DETAILED DESCRIPTION

Figure 1:
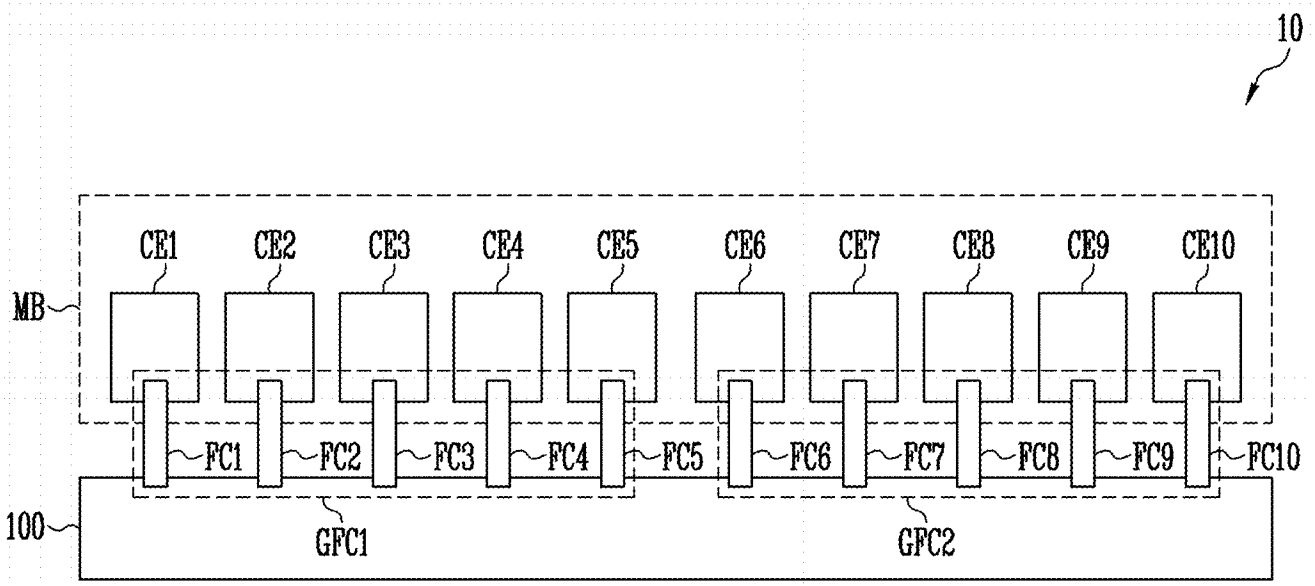
FIG. 1 is a diagram illustrating an exemplary embodiment of an aging system according to the invention.

Hereinafter, embodiments of the invention will be described in more detail with reference to the accompanying drawings. The drawings illustrate exemplary embodiments of the invention and, together with the description, serve to explain principles of the invention. It will be understood that when an element (or area, layer, portion, etc.) is referred to as being "on," "connected to," or "coupled to" another element, it may be directly on, connected to, or coupled to the other element, or intervening elements may be present.

Like numbers refer to like elements throughout, and duplicative descriptions thereof may not be provided. The thicknesses, ratios, and dimensions of elements may be exaggerated in the drawings for clarity. As used herein, the term "and/or" includes any and all combinations of one or more of the associated listed items.

It will be understood that, although the terms "first," "second," etc. may be used herein to describe one or more elements, these terms should not be construed as limiting such elements. These terms are only used to distinguish one element from another element. Thus, a first element could be alternately termed a second element without departing from the spirit and scope of the invention. Similarly, a second element could be alternately termed a first element. Singular forms of terms are intended to include the plural forms as well, unless the context clearly indicates otherwise.

Moreover, spatially relative terms, such as "beneath," "below," "lower," "above," "upper," and the like may be used herein for ease of description to describe one element's spatial relationship to another element(s) as illustrated in the drawings. It will be understood that the spatially relative terms are intended to encompass different orientations of the device in use or in operation, in addition to the orientation depicted in the drawing figures. In an exemplary embodiment, when the device in the drawing figures is turned over, elements described as "below" or "beneath" or "under" other elements or features would then be oriented "above" the other elements or features. Thus, the example terms "below" and "under" may encompass both an orientation of above and below. The device may be otherwise oriented (e.g., rotated 90 degrees or at other orientations) and the spatially relative descriptors used herein should be interpreted accordingly.

It will be further understood that the terms "includes" and "including," when used in this invention, specify the presence of stated features, integers, acts, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a diagram illustrating an aging system according to an exemplary embodiment of the invention.

Referring to FIG. 1, the aging system 10 may include an auxiliary board MB and an aging device 100.

The auxiliary board MB may include a plurality of display panels CE1 to CE10.

In some exemplary embodiments, first to tenth display panels CE1 to CE10 may be located on the auxiliary board MB.

The plurality of display panels CE1 to CE10 will be described in detail with reference to FIG. 3.

In some exemplary embodiments, the plurality of display panels CE1 to CE10 may be arranged in a first direction on the auxiliary board MB (e.g., horizontal direction in FIG. 1). However, the invention is not limited thereto, and the plurality of display panels CE1 to CE10 may be arranged in a matrix form or other forms.

The auxiliary board MB may include a synthetic resin layer. In an exemplary embodiment, the synthetic resin layer may be a polyimide-based resin layer, for example, and the material of the synthetic resin layer is not particularly limited. In an exemplary embodiment, the auxiliary board MB may include a glass substrate, a metal substrate, an organic/inorganic composite material substrate, etc., for example.

Although not shown in FIG. 1, the auxiliary board MB may include a plurality of line structures. The plurality of line structures may be used to perform aging on the plurality of display panels CE1 to CE10.

The plurality of display panels CE1 to CE10 may be grouped.

In an exemplary embodiment, the first to fifth display panels CE1 to CE5 may be grouped as a first panel group CG1 (refer to FIG. 2), and the sixth to tenth display panels CE6 to CE10 may be grouped as a second panel group CG2 (refer to FIG. 2), for example.

The aging device 100 may perform aging on the plurality of display panels CE1 to CE10. In an exemplary embodiment, the aging device 100 may perform aging by applying aging signals to the plurality of display panels CE1 to CE10. The aging device 100 will be described in detail with reference to FIG. 2, for example.

The aging system 10 may further include a plurality of line boards FC1 to FC10.

In some exemplary embodiments, the aging system 10 may include first to tenth line boards FC1 to FC10. In this case, the first to tenth line boards FC1 to FC10 may correspond to the first to tenth display panels CE1 to CE10, respectively.

In some exemplary embodiments, each of the plurality of line boards FC1 to FC10 may be implemented with a flexible printed circuit board ("FPCB").

The plurality of line boards FC1 to FC10 may be grouped.

In an exemplary embodiment, the first to fifth line boards FC1 to FC5 may be grouped as a first board group GFC1, and the sixth to tenth line boards FC6 to FC10 may be grouped as a second board group GFC2, for example.

In some exemplary embodiments, the first board group GFC1 may be implemented with a FPCB in which the first to fifth line boards FC1 to FC5 are integrated as one, and the second board group GFC2 may be implemented with a FPCB in which the sixth to tenth line boards FC6 to FC10 are integrated as one.

In this case, the first board group GFC1 and the second board group GFC2 may correspond to the first panel group CG1 (refer to FIG. 2) and the second panel group CG2 (refer to FIG. 2), respectively.

However, the invention is not limited thereto, and the first board group GFC1 and the second board group GFC2 may also be implemented with a FPCB in which the first board group GFC1 and the second board group GFC2 are integrated as one.

In this case, the FPCB in which the first board group GFC1 and the second board group GFC2 are integrated as one may correspond to the auxiliary board.

The plurality of line boards FC1 to FC10 may include various signal lines. This will be described in detail with reference to FIG. 2.

In some exemplary embodiments, the plurality of line boards FC1 to FC10 may have flexibility.

Figure 2:
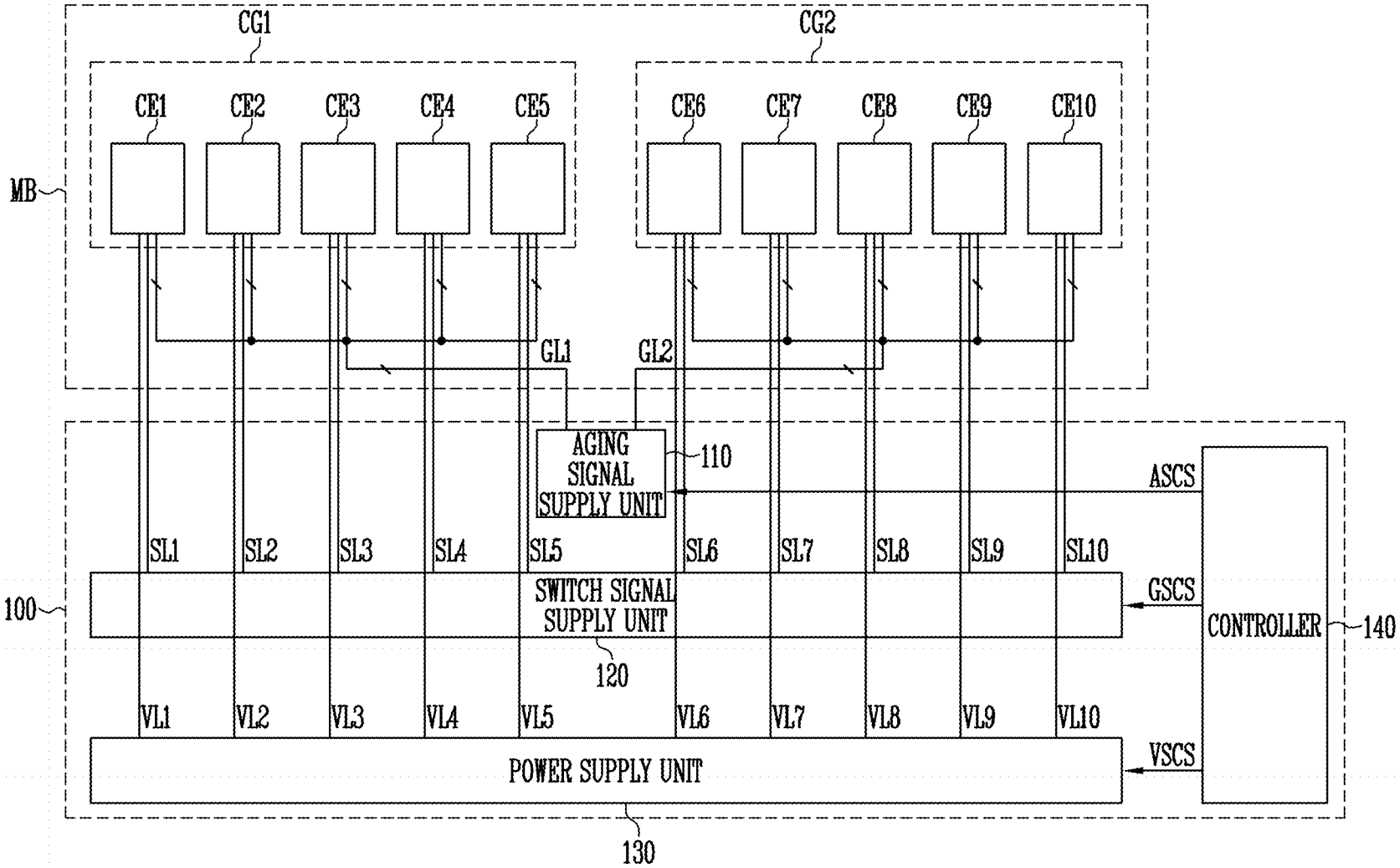
FIG. 2 is a diagram illustrating in detail the exemplary embodiment of the aging system according to the invention.

FIG. 2 is a diagram illustrating in detail the aging system according to the exemplary embodiment of the invention.

Referring to FIG. 2, the aging system 10 may include a plurality of panel groups CG1 and CG2. In some exemplary embodiments, the aging system 10 may include a first panel group CG1 and a second panel group CG2.

Each of the plurality of panel groups CG1 and CG2 may include a plurality of display panels (i.e., CE1 to CE5 or CE6 to CE10).

In an exemplary embodiment, the first panel group CG1 may include the first to fifth display panels CE1 to CE5, and the second panel group CG2 may include the sixth to tenth display panels CE6 to CE10, for example.

The first to fifth display panels CE1 to CE5 may be coupled to a first group signal line GL1, and the sixth to tenth display panels CE6 to CE10 may be coupled to a second group signal line GL2. That is, the group signal lines GL1 and GL2 may correspond to the panel groups CG1 and CG2, respectively.

The first to tenth display panels CE1 to CE10 may be supplied with aging signals through the first and second group signal lines GL1 and GL2.

Each aging signal may include various control signals or clock signals applied to components included in each of the display panels CE1 to CE10.

The first to tenth display panels CE1 to CE10 may be coupled to first to tenth switch signal lines SL1 to SL10, respectively. The first to tenth display panels CE1 to CE10 may be supplied with switch signals through the first to tenth switch signal lines SL1 to SL10. That is, the switch signal lines SL1 to SL10 may correspond to the display panels CE1 to CE10, respectively.

Each of the first to tenth display panels CE1 to CE10 may be coupled to first to tenth power lines VL1 to VL10, respectively. The first to tenth display panels CE1 to CE10 may be supplied with an aging power source through the first to tenth power lines VL1 to VL10. That is, the power lines VL1 to VL10 may correspond to the display panels CE1 to CE10, respectively.

The aging power source is a power source used to perform aging on the plurality of display panels CE1 to CE10. In an exemplary embodiment, the aging power source may include a pixel power source, a reference power source, etc., for example.

Referring to FIGS. 1 and 2, each of the group signal lines GL1 and GL2, the switch signal lines SL1 to SL10, and the power lines VL1 to VL10 may be disposed on a corresponding one of the line boards FC1 to FC10 or a corresponding one of the board groups CFC1 and CFC2.

In an exemplary embodiment, the first group signal line GL1 may be disposed on any one of the first to fifth line boards FC1 to FC5 included in the first board group GFC1, and the second group signal line GL2 may be disposed on any one of the sixth to tenth line boards FC6 to FC10 included in the second board group GFC2, for example.

Each of the first to tenth switch signal lines SL1 to SL10 may be disposed on a corresponding one of the first to tenth line boards FC1 to FC10.

The aging device 100 may include an aging signal supply unit 110, a switch signal supply unit 120, a power supply unit 130, and a controller 140.

The aging signal supply unit 110 may generate aging signals.

The aging signal supply unit 110 may supply aging signals to the plurality of display panels CE1 to CE10 through the first and second group signal lines GL1 and GL2. That is, the aging signal supply unit 110 may supply a corresponding aging signal to a corresponding panel group through a corresponding group signal line.

In an exemplary embodiment, the aging signal supply unit 110 may supply a first aging signal to the first panel group CG1 through the first group signal line GL1, and supply a second aging signal to the second panel group CG2 thorough the second group signal line GL2, for example.

The aging signal supply unit 110 may receive an aging signal control signal ASCS from the controller 140. The aging signal supply unit 110 may operate in response to the aging signal control signal ASCS.

The aging signal supply unit 110 may detect an error, corresponding to the supplied aging signals. In an exemplary embodiment, the aging signal supply unit 110 may detect an error by sensing abnormality of currents or voltages of the aging signals, for example.

The error may include a board error or a panel error.

In this specification, the panel error means a short, burnt, or the like, which occurs in at least one of the plurality of display panels CE1 to CE10, and the board error means a short, burnt, or the like, which occurs in at least one of the plurality of line substrates FC1 to FC10.

In addition, the aging device 100 may determine whether the detected error corresponds to the board error. This will be described in detail with reference to FIGS. 5 and 6.

The switch signal supply unit 120 may generate switch signals.

The switch signal supply unit 120 may supply switch signals to the plurality of display panels CE1 to CE10 through the first to tenth switch signal lines SL1 to SL10. That is, the switch signal supply unit 120 may supply a corresponding switch signal to a corresponding display panel through a corresponding switch signal line.

In an exemplary embodiment, the switch signal supply unit 120 may supply each switch signal to a corresponding display panel among the first to tenth display panels CE1 to CE10, for example.

In addition, the switch signal supply unit 120 may selectively supply each switch signal to the first to tenth display panels CE1 to CE10.

The switch signal supply unit 120 may receive a switch signal control signal GSCS from the controller 140. The switch signal supply unit 120 may operate in response to the switch signal control signal GSCS.

The power supply unit 130 may generate an aging power source.

The power supply unit 130 may supply an aging power source to the plurality of display panels CE1 to CE10 through the first to tenth power lines VL1 to VL10. That is, the power supply unit 130 may supply a corresponding aging power source to a corresponding display panel through a corresponding power line.

In an exemplary embodiment, the power supply unit 130 may supply an aging power source to the first to tenth display panels CE1 to CE10, for example.

The power supply unit 130 may receive a power supply control signal VSCS from the controller 140. The power supply unit 130 may operate in response to the power supply control signal VSCS.

The aging power source is a power source used to perform aging on the plurality of display panels CE1 to CE10. In an exemplary embodiment, the aging power source may include a pixel power source, a reference power source, etc., for example.

The controller 140 may control overall operations of the aging device 100. That is, the controller 140 may control the aging signal supply unit 110, the switch signal supply unit 120, and the power supply unit 130.

In an exemplary embodiment, the controller 140 may generate the aging signal control signal ASCS, the switch signal control signal GSCS, and the power supply control signal VSCS, for example.

The controller 140 may transmit the aging signal control signal ASCS to the aging signal supply unit 110, supply the switch signal control signal GSCS to the switch signal supply unit 120, and supply the power supply control signal VSCS to the power supply unit 130.

Figure 3:
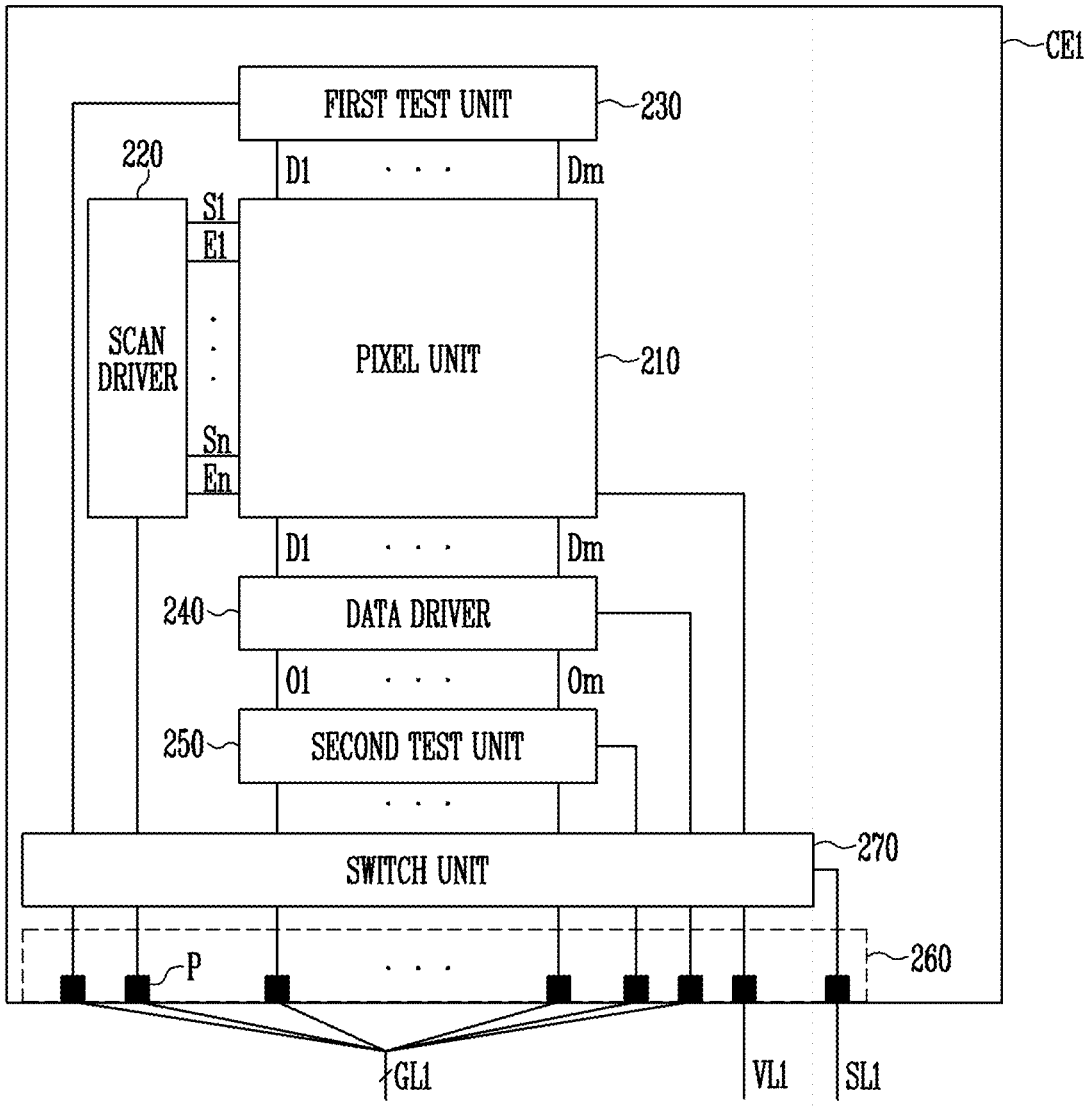
FIG. 3 is a diagram illustrating in detail the exemplary embodiment of a display panel according the invention.

FIG. 3 is a diagram illustrating in detail the display panel according the exemplary embodiment of the invention. For convenience of description, only the first display panel CE1 shown in FIG. 2 is illustrated in FIG. 3, but it will be apparent that the following description may be applied to the other display panels.

Referring to FIG. 3, the display panel CE1 may include a pixel unit 210, a scan driver 220, a first test unit 230, a data driver 240, a second test unit 250, a pad unit 260, and a switch unit 270.

The pixel unit 210 may include a plurality of pixels (not shown) located at intersection portions of data lines D1 to Dm, scan lines S1 to Sn, and emission control lines E1 to En where n and m are natural numbers. In addition, each pixel may include an organic light emitting diode ("OLED") and transistors for driving the OLED.

The scan driver 220 may generate a scan signal and/or an emission control signal, and sequentially supply the scan signal and/or the emission control signal to the scan lines S1 to Sn and/or the emission control lines E1 to En. At this time, the scan signal and/or the emission control signal, generated from the scan driver 220, may be set to a gate-on level voltage.

The first test unit 230 may be electrically coupled to one ends of the data lines D1 to Dm, and operate to perform aging.

The data driver 240 may be coupled between the second test unit 250 and the pixel unit 210. The data driver 240 may supply aging signals supplied from output lines O1 to Om of the second test unit 250 to the data lines D1 to Dm, corresponding to clock signals (e.g., red, green, and blue clock signals) supplied from the outside. In an exemplary embodiment, when one pixel includes three sub-pixels, i.e., red, green, and blue sub-pixels, the data driver 240 may supply aging signals supplied from the second test unit 250 to three data lines of the red, green, and blue sub-pixels, for example.

After aging performed on the display panel CE1 is completed, the data driver 240 may supply a data signal supplied from the output lines O1 to Om to the data lines D1 to Dm of the sub-pixels.

The second test unit 250 may be electrically coupled to one ends of the data lines D1 to Dm through the data driver 240. That is, the second test unit 250 and the first test unit 230 are coupled to different ends of the data lines D1 to Dm. The second test unit 250 and the first test unit 230 may be disposed to be opposite to each other with the pixel unit 210 interposed therebetween.

The first test unit 230 and the second test unit 250 may operate to perform aging on the plurality of display panels CE1 to CE10 (refer to FIGS. 1 and 2). In an exemplary embodiment, the first test unit 230 and the second test unit 250 apply a specific voltage to the data lines D1 to Dm, and allow a current to flow through the OLED, thereby performing the aging, for example.

The pad unit 260 may include a plurality of pads P. The plurality of pads P may receive an aging signal, an aging power source, and a switch signal, which are supplied from the outside. As shown in FIG. 3, the aging signal may include various signals applied to components included in the display panel CE1.

The switch unit 270 may supply an aging signal and an aging power source, which are supplied from the pad unit 260, to the inside of the display panel CE1. In an exemplary embodiment, the switch unit 270 may include a plurality of switches. This will be described in detail with reference to FIG. 4, for example.

Although a case where the circuits including the scan driver 220, the first test unit 230, the data driver 240, the second test unit 250, and the like are separated from one another is illustrated in FIG. 3, the invention is not limited thereto, and some of the components may be integrated, when necessary.

Figure 4:
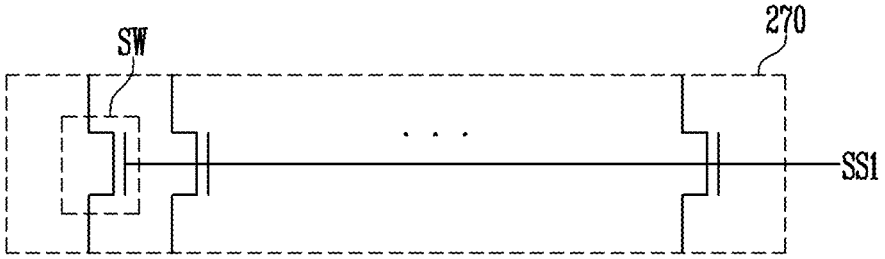
FIG. 4 is a diagram illustrating in detail the exemplary embodiment of a switch unit according to the invention.

FIG. 4 is a diagram illustrating in detail the switch unit according to the exemplary embodiment of the invention.

Referring to FIGS. 2 to 4, the switch unit 270 may include a plurality of switches SW. The plurality of switches SW may be switched according to a first switch signal SS1 supplied from the first switch signal line SL1.

In some exemplary embodiments, the switch SW may be implemented with any one of an N-type metal-oxide-semiconductor ("N-MOS") transistor and a P-type metal-oxide-semiconductor ("P-MOS transistor"). In this case, a gate electrode of the switch SW may be coupled to the first switch signal line SL1. In addition, the first switch signal SS1 may have a gate-on voltage. When the first switch signal SS1 is supplied, the switch SW may be turned on. Thus, the switch unit 270 supplies an aging signal and an aging power source, which are supplied from the pad unit 260, to the inside of the display panel CE1.

Figure 5:
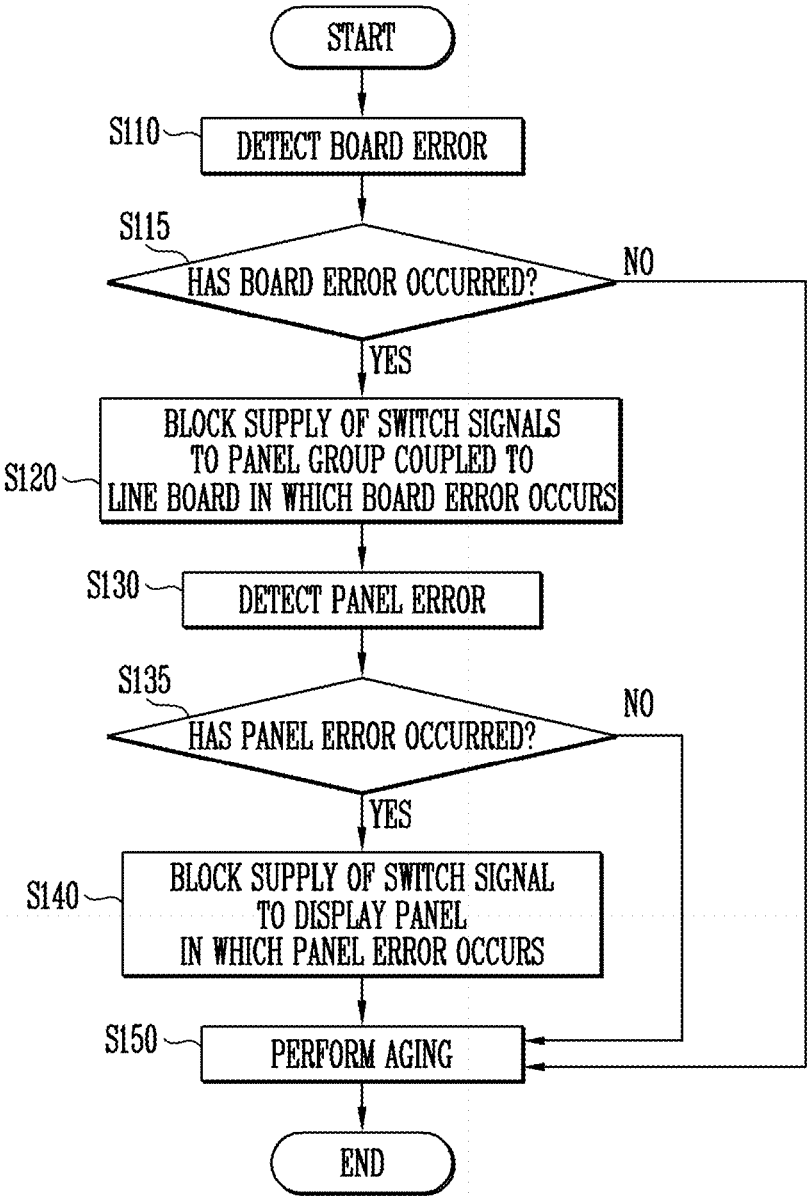
FIG. 5 is a flowchart illustrating an exemplary embodiment of a method for operating the aging system according to the invention.

FIG. 5 is a flowchart illustrating a method for operating the aging system according to an exemplary embodiment of the invention. Hereinafter, the method for operating the aging system according to the exemplary embodiment of the invention will be described with reference to FIGS. 1 to 5.

In operation S110, the aging device 100 may detect a board error.

When the board error has occurred (Yes in operation S115), the aging device 100 may block the supply of all switch signals. In an exemplary embodiment, the switch signal supply unit 120 may block the supply of switch signals supplied to the display panels CE1 to CE10 under the control of the controller 140, for example.

Next, the aging device 100 may supply aging signals to the plurality of display panels CE1 to CE10. In an exemplary embodiment, the aging signal supply unit 110 may supply aging signals to the panel groups CG1 and CG2 for a first supply time, for example.

The aging signal supply unit 110 may detect a board error by sensing abnormality of currents or voltages of the supplied aging signals.

In this specification, the first supply time may be a time sufficient for the aging signal supply unit 110 to sense abnormality of the currents or voltages supplied by the aging signal supply unit 110.

In an exemplary embodiment, when it is assumed that a board error occurs in the third line board FC3, the aging signal supply unit 110 may detect the board error that occurs in the third line board FC3, for example.

In operation S120, the aging device 100 may block the supply of switch signals to the panel group coupled to the line board in which the board error occurs. That is, the aging device 100 may block the supply of switch signals to only a panel group coupled to only a line board in which the board error occurs.

In an exemplary embodiment, when it is assumed that a board error occurs in the third line board FC3, the switch signal supply unit 120 may block only the supply of switch signals to only the first panel group CG1 coupled to the third line board FC3, and supply the switch signals to the second panel group CG2, for example.

In operation S130, the aging device 100 may detect a panel error.

When the panel error has occurred (Yes in operation S135), the aging device 100 may supply aging signals to the plurality of display panels CE1 to CE10. In an exemplary embodiment, the aging signal supply unit 110 may supply aging signals to at least one of the panel groups CG1 and CG2 for the first supply time, for example.

In some exemplary embodiments, the aging signal supply unit 110 may not supply any aging signal to the panel group to which the supply of switch signals is blocked.

Next, the aging signal supply unit 110 may detect a panel error by sensing abnormality of currents or voltages of the supplied aging signals.

In operation S140, the aging device 100 may block the supply of a switch signal to the display panel in which the panel error occurs.

In an exemplary embodiment, when it is assumed that a panel error occurs in the seventh display panel CE7, the switch signal supply unit 120 may block the supply of a switch signal to the seventh display panel CE7, for example.

In operation S150, the aging device 100 may perform aging on the plurality of display panels CE1 to CE10.

The aging device 100 may perform aging by supplying aging signals to the auxiliary board MB for a second supply time. In an exemplary embodiment, the aging signal supply unit 110 may perform aging by supplying aging signals to the plurality of display panels CE1 to CE10 for the second supply time, for example.

In this specification, the second supply time may be a time sufficient for the aging signal supply unit 110 to perform aging on the plurality of display panels CE1 to CE10.

In some exemplary embodiments, the first supply time may be shorter than the second supply time.

Figure 6:
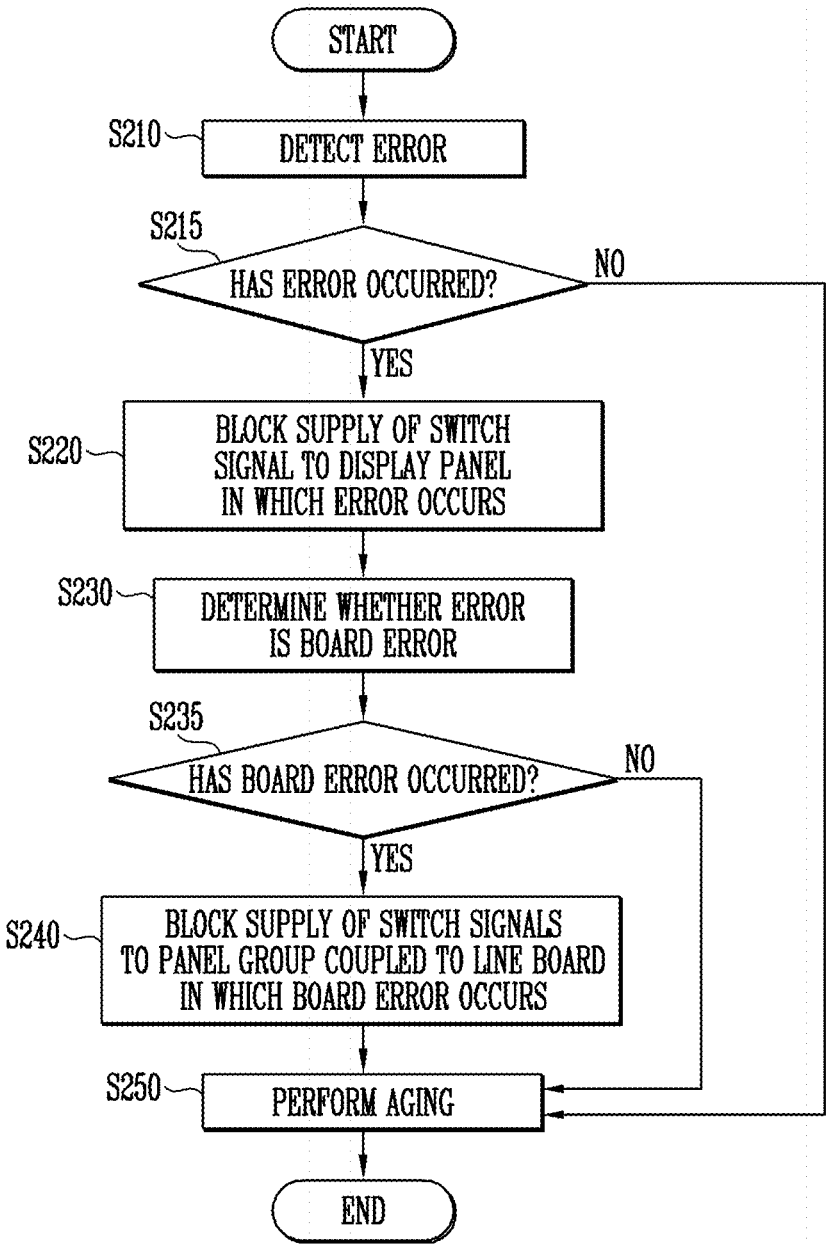
FIG. 6 is a flowchart illustrating another exemplary embodiment of a method for operating the aging system according to the invention.

FIG. 6 is a flowchart illustrating a method for operating the aging system according to another exemplary embodiment of the invention. Hereinafter, the method for operating the aging system according to another exemplary embodiment of the invention will be described with reference to FIGS. 1 to 6.

In operation S210, the aging device 100 may detect an error.

When the error has occurred (Yes in operation S215), the aging device 100 may supply aging signals to the plurality of display panels CE1 to CE10. In an exemplary embodiment, the aging signal supply unit 110 may supply aging signals to the panel groups CG1 to CG2 for a first supply time, for example.

Next, the aging signal supply unit 110 may detect an error by sensing abnormality of currents or voltages of the supplied aging signals.

The error detected in this operation means an error that is uncertain to determine whether the error is a panel error or a board error. The error may be any one of the panel error and the board error.

In operation S220, the aging device 100 may block the supply of a switch signal to the display panel in which the error occurs.

In an exemplary embodiment, when it is assumed that an error occurs in the second display panel CE2, the switch signal supply unit 120 may block the supply of a switch signal to the second display panel CE2, for example.

In operation S230, the aging device 100 may determine whether the error is the board error.

The aging device 100 may supply aging signals to the plurality of display panels CE1 to CE10. In an exemplary embodiment, the aging signal supply unit 110 may supply aging signals to the panel groups CG1 to CG2 for the first supply time, for example.

When the error continuously occurs (S235), the aging signal supply unit 110 may determine that the error is the board error.

In operation S240, the aging device 100 may block the supply of switch signals to the panel group coupled to the line board in which the board error occurs.

In an exemplary embodiment, when it is assumed that a board error occurs in the third line board FC3, the switch signal supply unit 120 may block the supply of switch signals to the first panel group CG1 coupled to the third line board FC3, for example.

In operation S250, the aging device 100 may perform aging on the plurality of display panels CE1 to CE10.

The aging device 100 may perform aging by supplying aging signals to the plurality of display panels CE1 to CE10 for a second supply time. In an exemplary embodiment, the aging signal supply unit 110 may perform aging by supplying aging signals to the plurality of display panels CE1 to CE10 for the second supply time, for example.

As described above, according to the invention, it is possible to provide an aging system that enables aging to be efficiently performed on a plurality of display panels located on an auxiliary board and a method for operating the aging system.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other exemplary embodiments unless otherwise specifically indicated. Accordingly, it will be understood by those of skill in the art that various changes in form and details may be made without departing from the spirit and scope of the invention as set forth in the following claims.

What is claimed is:

1. An aging system comprising:

panel groups each including display panels;

an auxiliary board including the panel groups disposed thereon; and an aging device which supplies aging signals to the display panels through line boards to perform aging on the display panels, wherein the aging device supplies switch signals respectively to the display panels through the line boards, wherein each of the display panels includes a switch which supplies an aging signal of the aging signals to a pixel unit defined by a plurality of pixels according to a switch signal of the switch signals, wherein the aging device includes:

an aging signal supply unit which supplies the aging signals respectively to the panel groups through group signal lines corresponding to the panel groups; and a switch signal supply unit which supplies the switch signals respectively to the display panels through switch signal lines corresponding to the display panels, wherein the switch signal supply unit blocks a supply of all of the switch signals, and the aging signal supply unit supplies the aging signals to the display panels, and detects a board error of the line boards, and wherein the switch signal supply unit blocks the supply of switch signals to only a panel group coupled to only a line board in which the board error occurs.

2. The aging system of claim 1, wherein the switch includes at least one switch switched according to the switch signal.

3. The aging system of claim 2, wherein the switch is any one of an N-type metal-oxide-semiconductor transistor and a P-type metal-oxide-semiconductor transistor.

4. The aging system of claim 1, wherein the aging device includes:

a power supply unit which supplies an aging power source to the display panels through power lines corresponding to the display panels.

5. The aging system of claim 4, wherein the aging device further includes a controller which controls the aging signal supply unit, the switch signal supply unit, and the power supply unit.

6. The aging system of claim 4, wherein each of the group signal lines, the switch signal lines, and the power lines is disposed on a corresponding one of the line boards.

7. The aging system of claim 1, wherein the aging signal supply unit supplies the aging signals to the display panels, and detects a panel error of the display panels.

8. The aging system of claim 7, wherein the switch signal supply unit blocks the supply of a switch signal of the switch signals to a display panel of the display panels in which the panel error occurs.

9. A method for operating an aging system which includes panel groups each including display panels, an auxiliary board including the panel groups disposed thereon, and an aging device which supplies aging signals to the display panels through line boards, the method comprising:

detecting a board error;

blocking a supply of switch signals to a panel group coupled to a line board in which the board error occurs;

detecting a panel error;

blocking the supply of switch signals to a display panel of the display panels in which the panel error occurs; and performing aging on the display panels, wherein each of the display panels includes a switch which supplies an aging signal of the aging signals to a pixel unit defined by a plurality of pixels according to a switch signal of the switch signals, and wherein, in the detecting the board error, the aging device detects the board error by blocking the supply of all of the switch signals and then supplying the aging signals to the display panels for a first supply time.

10. The method of claim 9, wherein, in the detecting the panel error, the aging device detects the panel error by supplying the aging signals to the display panels for the first supply time.

11. The method of claim 10, wherein, in the performing the aging on the display panels, the aging device performs the aging by supplying the aging signals to the display panels for a second supply time, wherein the first supply time is shorter than the second supply time.

12. A method for operating an aging system which includes panel groups each including display panels, an auxiliary board including the panel groups disposed thereon, and an aging device which supplies aging signals to the display panels through line boards, the method comprising:

detecting an error;

blocking a supply of a switch signal to a display panel of the display panels in which the error occurs;

determining whether the error is a board error;

blocking the supply of switch signals to a panel group coupled to a line board in which the board error occurs; and performing aging on the display panels, wherein each of the display panels includes a switch which supplies the aging signal to a pixel unit defined by a plurality of pixels according to the switch signal, wherein, in the detecting the error, the aging device detects the error by supplying the aging signals to the display panel for a first supply time, and wherein, in the determining whether the error is the board error, the aging device supplies the aging signals to the display panels for the first supply time, and determines that the error is the board error when the error continuously occurs.

13. The method of claim 12, wherein, in the performing the aging on the display panels, the aging device performs the aging by supplying the aging signals to the display panels for a second supply time, wherein the first supply time is shorter than the second supply time.

* * * * *